United States Patent [19]

Darwent

[11] 4,230,205

[45] Oct. 28, 1980

[54] ELEVATOR SYSTEM

[75] Inventor: Richard H. Darwent, Hopatcong, N.J.

[73] Assignee: Westinghouse Electric Corp., Pittsburgh, Pa.

[21] Appl. No.: 904,685

[22] Filed: May 10, 1978

[51] Int. Cl.[3] ..... B66B 7/10

[52] U.S. Cl. ..... 187/22

[58] Field of Search ..... 187/20, 22, 94, 67

[56] References Cited

U.S. PATENT DOCUMENTS

| | | | |
|---|---|---|---|
| 1,132,761 | 3/1915 | Boening | 187/22 |
| 3,768,596 | 10/1973 | Solymos | 187/94 X |
| 3,810,529 | 5/1974 | Tosato et al. | 187/94 |
| 3,882,968 | 5/1975 | Suozzo | 187/94 X |

*Primary Examiner*—John J. Love
*Assistant Examiner*—Milton L. Smith
*Attorney, Agent, or Firm*—D. R. Lackey

[57] ABSTRACT

An elevator system including an elevator car and counterweight, hoist roping, and chain compensation for the weight of the hoist roping. A chain wheel spaces and guides the compensating chain. Vibration in the elevator car, and airborne noise due to the chain, are substantially reduced by a mounting assembly for the chain wheel which mounts the chain wheel on springs. The springs are adjustably biased to partially support the weight of the chain wheel, to reduce the loading on the compensating chain.

1 Claim, 2 Drawing Figures

FIG.1
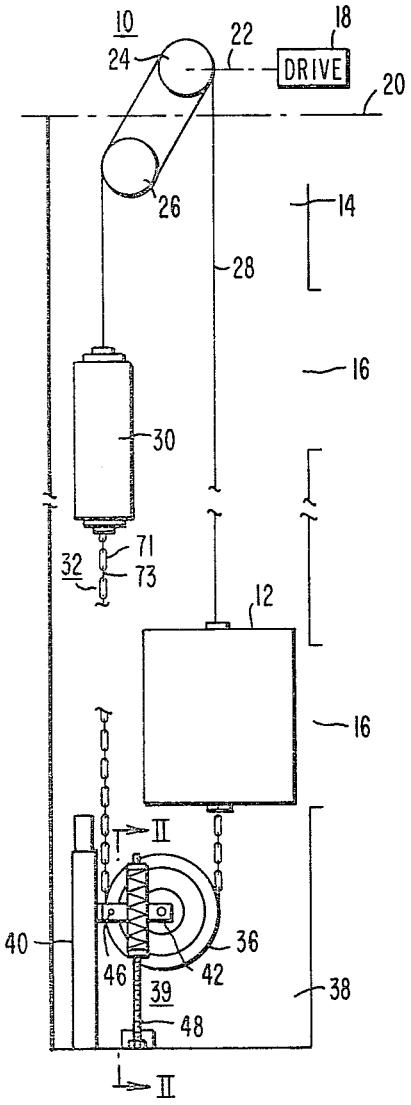
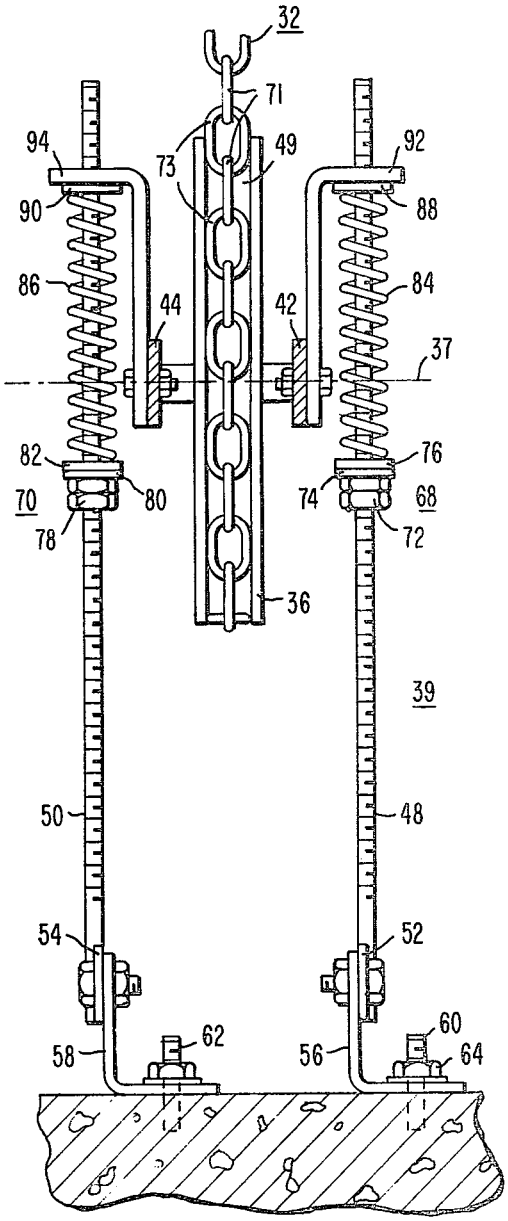
FIG.2

ELEVATOR SYSTEM

BACKGROUND OF THE INVENTION

1. Field of the Invention

The invention relates in general to elevator systems, and more specifically, to elevator systems which utilize chain compensation for the weight of the hoist roping.

2. Description of the Prior Art

Chain compensation for the weight of the hoist roping in a traction elevator system has distinct economic advantages over wire rope compensation. The major drawbacks of chain compensation are sway and noise, both of which increase in intensity with car speed. Thus, chain compensation has been limited to use on relatively slow speed elevator systems, but considerable effort has been directed toward reducing sway and noise in order to enable the use of chain compensation at higher and higher car speeds. For example, U.S. Pat. No. 3,768,596, which is assigned to the same assignee as the present application, teaches an arrangement for reducing chain noise. This arrangement extends the upper speed limit for chain compensated elevator systems to about 500 feet per minute. This patent discloses the use of resilient spacers formed of a material such as rubber, which are disposed about alternate links of the chain. The spacers are dimensioned to fully extend the links of the chain to maintain them in their extended position, which reduces noise in the natural loop of the chain formed below the elevator car and counterweight, and it also reduces the noise due to the chain striking components in the hoistway due to chain sway. U.S. Pat. No. 3,810,529, which is also assigned to the same assignee as the present application, teaches an arrangement which successfully extends chain compensation to still higher speed elevator systems, such as 700 feet per minute, which arrangement eliminates sway and reduces the noise level to a greater extent than the use of resilient spacers on the chain itself. In the arrangement of this patent, the compensating chain is firmly guided by a chain wheel or sheave which has a groove formed in its outer periphery by spaced elastomeric members. Alternate links of the chain extend edgewise into the circumferential grooves. The intervening links rest flatwise on the outer peripheries of the elastomeric members, outside the circumferential groove. This arrangement provides silencing and guiding functions without scraping, digging and twisting of the chain links.

While the arrangement of the latter patent substantially reduces chain noise and it eliminates sway, a certain amount of car vibration and/or airborne noise may occasionally be experienced with chain compensation, especially at the higher car speeds, such as 700 feet per minute. It has also been found that the magnitude of such vibration and noise varies substantially from installation to installation. Thus, it would be desirable to further reduce vibration and noise due to chain compensation, and to be able to reliably obtain such reductions under the widely varying conditions encountered in different elevator installations.

SUMMARY OF THE INVENTION

Prior art compensation systems support the chain wheel in the loop of the chain. Any springs provided in such systems are for the purpose of adding tension to the chain. Rope compensation systems also support the compensator sheave in the loop of the ropes, with any springs being associated with shock absorbing functions in lock-down arrangements. The present invention recognizes that vibration and airborne noise in chain compensation systems is increased by increased tension in the chain. Thus, instead of using springs to add tension to the chain, springs are used to reduce chain tension. The chain wheel is adjustably spring mounted, such that the springs support a portion of the weight of the chain wheel. It is only necessary to retain sufficient weight on the chain such that movement of the chain will rotate the chain wheel without slippage between the chain wheel and chain. This arrangement reduces vibration set up in the chain, and thus in the car, due to chordal action of the chain, and it reduces the airborne noise audible at the lower floor, or floors, due to the chain entering and leaving the circumferential groove in the outer periphery of the chain wheel.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 1 diagrammatically illustrates a traction elevator system constructed according to the teachings of the invention; and FIG. 2 is an enlarged, elevational view of the elevator system shown in FIG. 1, taken between and in the direction of arrows II—II.

DESCRIPTION OF THE PREFERRED EMBODIMENT

The present invention relates in general to traction elevator systems having chain compensation, and more specifically, to a new and improved mounting arrangement for the chain wheel of such systems. The teachings of the invention are applicable to any chain wheel construction, with the constructions disclosed in the hereinbefore mentioned U.S. Pat. No. 3,810,529 being particularly desirable, as they provide accurate guiding of the chain while reducing chain vibration and noise. U.S. Pat. No. 3,810,529 is hereby incorporated into the present application by reference, and it may be referred to for specific constructional details of a suitable chain wheel or compensator sheave.

Referring now to the drawings, and FIG. 1 in particular, there is shown a traction elevator system 10 constructed according to the teachings of the invention. Elevator system 10 includes an elevator car 12 mounted for movement in a hoistway 14 of a structure or building having a plurality of floors, indicated generally at 16, which floors are served by the elevator car 12. An elevator drive motor 18 may be mounted on the floor of a penthouse in the building, which floor is illustrated generally by line 20, with the drive motor having a drive shaft 22 to which a traction sheave 24 is secured. An idler or deflection sheave 26 may be secured to the lower surface of the penthouse floor 20, if required.

Hoist ropes or cables 28 interconnect the elevator car 12 with a counterweight 30. The hoist ropes 28, as illustrated, interconnect the elevator car 12 and counterweight 30 with a one-to-one roping arrangement, wherein they are directly connected to the crossheads of the elevator car 12 and counterweight 30, but a two-to-one roping may be used for either the car, or counterweight, or both, if desired.

Depending upon building height, the weight of the hoist ropes 28 may add significantly to the unbalanced load which must be lifted and accelerated by the elevator drive machine, with the amount of the unbalance continuously changing as the elevator car and counterweight move in the hoistway. Thus, it is conventional to provide some type of compensation system to reduce the unbalanced load for any position of the elevator car and counterweight in the hoistway. The compensation system makes torque requirements more uniform and assists in landing accuracy.

Compensation for the weight of the hoist ropes 28 is provided by a chain 32, a compensator sheave or chain wheel 36 disposed below the travel path of the elevator car 12, i.e., in the bottom part 38 of the hoistway 14, commonly referred to as the pit, and means 39 constructed according to the teachings of the invention for mounting the chain wheel in the pit. Buffers for the elevator car and counterweight 30 are also disposed in the pit, such as counterweight buffer 40.

The chain wheel 36 includes elastomeric means 49 disposed about the outer periphery thereof, providing a circumferential groove about the outer periphery of the chain wheel.

The chain 32 is an ordinary link chain having a series of interconnected metallic links, with alternate links 71 being of like orientation, and the intervening links 73 being of like orientation. The alternate links 71 extend edgewise into the circumferential groove provided by the resilient means on the outer periphery of the chain wheel, while the intervening links 73 lie flatwise on the outer periphery of the resilient means.

Chain wheel 36 is mounted according to the teachings of the invention to reduce the operating noise of the chain 32, and prevent sway thereof, at all elevator speeds at least up to 700–800 ft. per minute.

FIG. 2 is an enlarged, elevational view of the chain wheel mounting means 39 shown in FIG. 1, taken between and in the direction of arrows II—II. As illustrated in FIG. 2, chain wheel 36 is rotatably mounted on an axis 37 between first and second spaced plate members 42 and 44. Plate members 42 and 44 are pivotally mounted to a suitable support in the pit, such as to the counterweight buffer 40. The pivot axis, shown at 46 in FIG. 1, is horizontally oriented, permitting plate members 42 and 44, as well as chain wheel 36, to be pivoted about axis 46 in a vertical plane.

Simply pivotally mounting chain wheel 36 in the pit causes the full weight of the chain wheel to be applied to the chain 32. I have found that when the entire weight of the chain wheel 36 rests on the chain 32, the chordal action of the chain, as well as any unevenness or roughness in the chain wheel, may set up objectionable vibrations in the chain which are transmitted to the elevator car. In addition, airborne noise due to the chain entering and leaving the circumferential groove in the outer periphery of the chain wheel may be loud enough to be heard at the lower floor, or floors, such as at the lobby floor. I have found that the vibration and noise is proportional to the tension in the chain. Thus, instead of deliberately adding tension to the chain, such as in certain prior art installations, the present invention includes mounting means 39 for the chain wheel that is constructed to reduce the weight of the chain wheel resting on the chain, which reduces the tension in the chain accordingly. The amount of the load taken off the chain 32 is adjustable, permitting the load to be taken off the chain until the vibration and noise are not noticeable, either to passengers in the car, or to prospective passengers in the hallways. It is only necessary that sufficient weight be maintained on the chain to enable frictional engagement between the chain and the resilient outer periphery of the chain wheel to drive the chain wheel about its rotational axis 37.

More specifically, the mounting means 39 includes first and second threaded rod members 48 and 50, respectively, which are vertically mounted and secured to the floor of the pit. As illustrated, rod members 48 and 50 may be welded to plate members 52 and 54, respectively, and plate members 52 and 54 may have openings therein for receiving bolts for bolting the plate members to angle members 56 and 58, respectively. Angle members 56 and 58 are attached to upstanding stud members 60 and 62, which are secured to the floor of the pit via nuts 64 and 66, respectively.

Adjustable spring seats 68 and 70 are provided on each rod member 48 and 50, such as by a nut 72, a washer 74 and a collar 76 on rod member 48. In like manner, adjustable spring seat 70 includes a nut 78, a washer 80, and a collar 82. The positions of the spring seats 68 and 70 are adjustable selected merely by turning nuts 72 and 78, respectively.

Spiral springs 84 and 86 are telescoped over the upstanding ends of rod members 48 and 50, respectively, and upper spring seats are provided on their upper ends, such as by collars 88 and 90. Rod members having an O.D. of 0.625 inch, and spring members having a 0.362 inch wire diameter, a 3.25 inch O.D., and a free length of 10.312 inches, have been found to provide the desired results, but other sizes may be successfully used.

Right angle members 92 and 94 have one leg attached to plate members 42 and 44, respectively, such as by nut and bolt assemblies, and their other legs have openings therein sized to slidably receive rod members 48 and 50. The chain wheel 36 with its angle members 92 and 94 secured thereto, is lowered between rod members 48 and 50 such that the rod members extend through the openings in angle members 92 and 94. The angle members 92 and 94 thus rest against the upper spring seats or collars 88 and 90, and press downwardly on spring members 84 and 86. Adjusting nuts 72 and 78 are adjusted up, or down, to provide the desired division of the weight of the chain wheel 36 between the springs 84 and 86, and between the chain 32. In practice, the positions of nuts 72 and 78 are selected to provide the lowest chain vibration and the lowest airborne noise. Sufficient weight is always maintained on the chain to provide the necessary friction between the chain and the chain wheel in order to drive the chain wheel about its rotational axis without slippage.

While the invention has been described relative to a single chain wheel, it is to be understood that the invention is equally applicable to installations which use two spaced chain wheels to obtain the required spacing of the chain between the elevator car and counterweight. Also, the invention is applicable to installations which use two chains, either with a single chain wheel per chain, or two spaced chain wheels per chain.

I claim as my invention:

1. An elevator system, comprising:

an elevator car, a counterweight, means mounting said elevator car and counterweight for guided vertical movement in predetermined travel paths, including hoist roping interconnecting said elevator car and counterweight, a traction sheave, and drive means, and a chain compensation system free of any driving means said chain compensation system including:

at least one rotatable chain wheel disposed below the travel paths of said elevator car and counterweight, at least one compensating chain having a plurality of interconnected links, said at least one chain being reeved about said at least one chain wheel and connected to said elevator car and counterweight, mounting means for said at least one chain wheel, including spring means biased to divide the support of said at least one chain wheel between said spring means and said at least one compensating chain, means for adjustably selecting the division of the support of the chain wheel between the spring means and the compensating chain, with said means being adjusted to support a substantial portion of the weight of the chain wheel on the spring means, while retaining at least enough weight on the compensating chain to enable the compensating chain to rotate the chain wheel without slippage in response to movement of the compensating chain, to reduce chain vibration due to chordal action of the chain linnks, and to reduce airborne noise due to the chain entering and leaving the chain wheel by reducing the weight exerted by said chain wheel on said compensating chain, which reduces the tension in the chain.

* * * * *